United States Patent [19]

Myklebust et al.

[11] Patent Number: 4,781,470

[45] Date of Patent: Nov. 1, 1988

[54] FLEXIBLE CONTAINER WITH SEPARATE LIFTING AREA

[75] Inventors: Eirik Myklebust; Bjarne Omdal, both of Porsgrunn, Norway

[73] Assignee: Norsk Hydro a.s., Oslo, Norway

[21] Appl. No.: 897,005

[22] PCT Filed: Dec. 6, 1985

[86] PCT No.: PCT/NO85/00077

§ 371 Date: Aug. 11, 1986

§ 102(e) Date: Aug. 11, 1986

[87] PCT Pub. No.: WO86/03729

PCT Pub. Date: Jul. 3, 1986

[30] Foreign Application Priority Data

Dec. 21, 1984 [NO] Norway ..... 845158
Aug. 8, 1985 [NO] Norway ..... 853130

[51] Int. Cl.[4] ..... B65D 33/06

[52] U.S. Cl. ..... 383/7; 383/8; 383/48; 383/904

[58] Field of Search ..... 383/7, 8, 44, 54, 56, 383/904, 48

[56] References Cited

U.S. PATENT DOCUMENTS

| | | | |
|---|---|---|---|
| 172,039 | 1/1876 | Lazarevitch . | |
| 177,749 | 5/1876 | Redden . | |
| 1,053,605 | 2/1913 | Johnson | 383/44 |
| 2,040,336 | 5/1936 | Rosmait . | |
| 2,799,314 | 7/1957 | Dreyer et al. | 383/904 X |
| 3,186,627 | 6/1965 | Evenblij | 383/44 |
| 3,207,420 | 9/1965 | Navarrete-Kindelan . | |
| 3,214,081 | 10/1965 | Silverstein . | |
| 3,378,190 | 4/1968 | White | 383/7 X |
| 3,587,697 | 6/1971 | Silfverskiold . | |
| 3,680,769 | 8/1972 | Siekierski | 383/54 |
| 3,789,897 | 2/1974 | Saito . | |
| 3,986,661 | 10/1976 | Johnson | 383/7 |
| 4,010,784 | 3/1977 | Nattrass et al. . | |
| 4,136,723 | 1/1979 | Skaadel et al. . | |
| 4,149,339 | 4/1979 | Hall et al. | 383/8 X |
| 4,191,229 | 3/1980 | Skaadel et al. . | |
| 4,221,250 | 9/1980 | Manerba | 383/904 X |
| 4,223,709 | 9/1980 | Myklebust | 383/8 X |
| 4,269,247 | 5/1981 | Omdal | 383/8 |
| 4,271,883 | 6/1981 | Krause | 383/7 |
| 4,300,608 | 11/1981 | Cuthbertson | 383/7 |
| 4,312,392 | 1/1982 | Sekiguchi | 383/8 |
| 4,393,910 | 7/1983 | Rasmussen | 383/8 |
| 4,584,705 | 4/1986 | Myklebust et al. | 383/8 |
| 4,650,452 | 3/1987 | Jensen | 383/904 X |

FOREIGN PATENT DOCUMENTS

| | | | |
|---|---|---|---|
| 624701 | 8/1961 | Canada | 389/904 |
| 764267 | 8/1967 | Canada | 383/54 |
| 26287 | 4/1981 | European Pat. Off. | 383/7 |
| 47389 | 3/1982 | European Pat. Off. | 383/8 |
| 0118112 | 9/1984 | European Pat. Off. . | |
| 1298441 | 6/1969 | Fed. Rep. of Germany | 383/54 |
| 2468512 | 5/1981 | France | 383/8 |
| 670326 | 10/1964 | Italy | 383/44 |
| 172982 | 9/1975 | New Zealand . | |
| 1505583 | 3/1978 | United Kingdom . | |
| 2044729 | 10/1980 | United Kingdom | 383/44 |
| 1581438 | 12/1980 | United Kingdom . | |
| 2055752 | 3/1981 | United Kingdom | 383/7 |
| 2077221 | 12/1981 | United Kingdom | 383/8 |
| 2086842 | 5/1982 | United Kingdom | 383/8 |

*Primary Examiner*—Stephen P. Garbe
*Attorney, Agent, or Firm*—Wenderoth, Lind & Ponack

[57] ABSTRACT

A flexible container for transportation and storage of bulk material includes integral lifting loops having openings for the insertion of lifting devices. In the upper part of the container is placed a separating member, preferably of flexible material, which separates and can close off that part of the container to be filled with bulk material from the lifting area of the container. The separating member is fastened to the container adjacent the openings thereof and possibly also to walls of the container or is pressed thereagainst by a lifting handle sleeve. A filling spout preferably is an integral part of the separating member. Also, the separating member can be Y-shaped or T-shaped including legs or branches that can be equally long or have different lengths. Side legs or branches have openings adjacent edges of which are fastened adjacent the openings in the lifting loops of the container. Parts of the legs or branches or extensions thereof can be used for joining the lifting loops to form one or several permanent lifting handles.

16 Claims, 3 Drawing Sheets

FLEXIBLE CONTAINER WITH SEPARATE LIFTING AREA

BACKGROUND OF THE INVENTION

The present invention relates to flexible containers for use in the transportation and storage of bulk material. Such a container includes integral lifting loops which are direct extensions of the side walls of the container and which form openings for lifting means.

Containers of the above mentioned type have been in use for some time and have proved to be well suited for several purposes. Usually they comprise a liner of impervious material, and when they are to be filled with free-flowing bulk material the liner is usually first inflated by air. U.S. Pat. No. 4,136,723 shows such a container having bottom flaps crossing each other. The container is preferably equipped with two integral lifting loops having a total width substantially equal to half of the container's circumference such that the lifting loops are formed by all of the longitudinal fibers of the container. By using an apparatus described in Great Britain Patent No. 1,505,583 a filled container can stand upright on the floor without any extra support. Its lifting loops can also hang on a hook or the like before inflation and filling of bulk material. The container is made ready for further transport after filling. This may involve closure of the liner and joining of the lifting loops such that one obtains a suitable loop which easily can be placed on a hook or other lifting means by pressing the lifting loops together and securing them in this position. Joining of the lifting loops to a permanent lifting handle can, however, be carried out before the container is filled with bulk material as described in Norwegian Patent Application No. 830,718 (corresponding to European No. 118,112).

By use of a container with a liner of impervious material, the function of the liner is to protect the bulk material in the container against contamination, and to close the container such that the bulk material therein will not flow out if the container topples, for instance due to incorrect handling. In this connection it should be mentioned that the liner must of course be kept completely watertight until discharge, however, experience shows that the upper part of the liner can easily be damaged by lifting means. The liner often is used just to fulfil this function of preventing the bulk material from flowing out of the container, as several types of bulk material do not need to be protected against contamination.

In certain cases, especially during filling of dusty bulk material in flexible containers having at least one lifting loop, the primary function of the liner is to form a filling spout which is placed tightly around the filling pipe and thereby to prevent dust formation during the filling operation.

The liner represents a relatively large part of the total cost of the container. The use of such a liner, if it is only to prevent the bulk material in the container from flowing out due to incorrect handling or if it is only to be used as a filling spout, is therefore not very economical.

However, several types of bulk material require protection against contamination, and a liner has to be used. When a container having integral lifting loops with or without a permanent lifting handle is used, contaminants entering through the openings in the lifting loops can get into the space between the liner and the outer container. When the container is emptied, the pressure from the bulk material against the liner which keeps it against the outer container's walls ceases, and possible contaminants in such space can follow the bulk material out of the container and contaminate the material when being discharged from the container.

Flexible containers as shown in U.S. Pat. No. 4,136,723, having a squarish bottom construction and where the container is equipped with two integral lifting loops having a total width substantially equal to half of the container's circumference, are well suited for transportation and storage of bulk material without the use of a liner of impervious material if the container is closed just below the lifting loop. A known way of doing this is, for instance, by tying a rope around the container below the lifting loops in the form of a clove hitch or the like.

Such method however has the following disadvantages. This closing operation has to be carried out after the bulk material has been filled into the container, since the rope closes the fill opening of the container, and the capacity of the filling apparatus cannot be fully utilized. When the container is pressed together below the lifting loop, channels easily can be formed in the gathered material so that the container will not necessarily be completely closed. The knot in the rope may slip. The capacity of the container cannot be fully utilized, since its net volume is reduced when the container is lashed below the fill opening.

SUMMARY OF THE INVENTION

The main object of the present invention is to provide a new manner of closing the container such that the container will function without the use of a liner of impervious material and without reducing its transportation and storage capacity.

Another object is to be able to close the container also when a liner is used, to thus prevent contaminants from getting into the space between the outer container and the liner such that the bulk material will not be contaminated as the container is discharged and the liner no longer presses against the outer walls of the container.

A further object is to provide means or special features of the outer container which ensure that the liner will not be damaged by lifting means.

One way of solving the problem related to intrusion of contaminants is to cover the complete container with an external hood of suitable impervious material. Below the top of such a hood an opening will have to be made for insertion of lifting means into the lifting loop, accordingly preventing contaminants from entering into the container.

Containers having four lifting loops or containers of the hood-lift type have at least two of their container walls terminating just above the filling height of bulk material. In order to obtain structural stability it has been common to fasten a lid of flexible material at the top of such container or to constrict the container's walls above or at those places where the lifting loops are fastened to the container ("Four-loop flexible IBC"). If a lid is used, one can either cut a filling opening in it or fasten a filling spout to it. Extensions of the constricted container walls can also form a filling spout. In those cases one will get a filling spout which can be closed after filling the bulk material into the container. For these types of containers the above main object is achieved by placing an external filling spout at the outer extremities of the container.

From U.S. Pat. No. 4,010,784 it is also known to equip a four-loop flexible container with a lid which is fastened around the complete circumference of the top of the container. In the lid there is a fill opening which can be closed by a rope. It is, however, difficult to obtain complete closure of the opening in this way.

For containers having integral lifting loops where the width of the lifting loop or loops comprises substantially one half of the container's circumference, one can of course also place a filling spout in the container's outer wall and close such spout after filling of bulk material. But the problem is not solved as the lifting loops still will have two openings leading into the space between the container and the liner.

Another way of solving the problem is to separate that area or part of the container which includes the integral lifting loops from that area of the container which is to be filled by bulk material.

Previously it has been mentioned that one could close the container after having filled the container with bulk material by tying a rope around it below the lifting loop. By pressing the container's walls together in this way one obtains a partitioning into a "lifting area or compartment" and a "cargo area or compartment". One may of course also tie a rope around the container and press it together before it is filled with bulk material when one places an external filling spout in the container's wall below the place where it is pressed together. The capacity of the filling equipment can thereby be better utilized, but the container's lifting strength is then weakened and the capacity is reduced.

Further development of the idea of splitting the container into a lifting area and a cargo compartment illustrates that the problem of separating the lifting area and the cargo compartment can be solved relatively simply by placing a piece of material, forming a separating member, in the lifting area and joining the edges of such member at opposite ends thereof with corresponding edges of the two openings in the lifting loop. The lifting area then is separated from the cargo compartment and the lifting area is open for insertion of lifting means while the cargo compartment is closed to hold the bulk material. A container having integral overlapping lifting loops can be joined in such a way that a separating pipe-shaped member is formed.

In order to get the bulk material into the container one has, however, to use a filling spout which leads into the cargo compartment. If the above described piece of material is replaced by a T-shaped member placed in the openings of the lifting loop, the downwardly directed leg of the T can be pulled out through one of the two openings of the lifting loop so that it can be utilized as a filling spout, since it leads directly into the container's cargo compartment.

The length of the wings of the T-shaped member can be varied as desired, from a length larger than the width of the flat container to 0, i.e. without side legs. When the wings or side legs of the T-shaped member are not provided, the partitioning piece of material can be made in several ways:

(1) from a round-woven piece of material;

(2) from a flat-woven piece of material folded double and sewn together in its lower part and thereupon sewn in the same way as described above;

(3) from two flat pieces of material which are sewn together. The spout is drawn out through the side openings during filling. After filling it can be folded and put back into the container;

(4) from a piece of material in the shape of the lifting area. Filling of bulk material then is performed through a separate filling spout.

The special features of the invention are accordingly that a separating member is fitted within the interior of the container, which thereby is divided into a lifting area and a cargo compartment. The piece of material forming the separating member can be formed such that it in addition can serve as a fill opening for feeding the bulk material into the cargo compartment. A branch of the piece of material which is used as a filling spout can be drawn out through one of the openings of the lifting loop or through a central filling opening for filling, and it will then be closed after the filling of bulk material is finished. The branch can be a downwardly extending leg of a T-shaped piece of material in one arrangement of carrying out the invention. For containers having integral overlapping lifting loops, this way of arranging the filling spout will be obvious.

BRIEF DESCRIPTION OF THE DRAWINGS

The invention will now be further explained in connection with the accompanying drawings showing various embodiments of the invention.

DETAILED DESCRIPTION OF THE INVENTION

Figure 1:
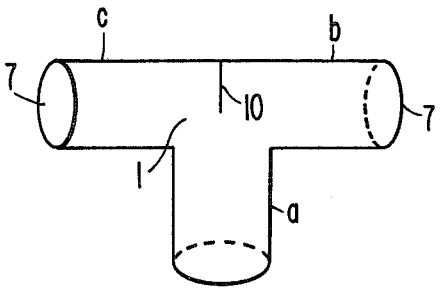
FIG. 1 is a schematic perspective view of a T-shaped flexible piece of material having several branch pipes and forming a separating member according to one embodiment of the invention.
Figure 2:
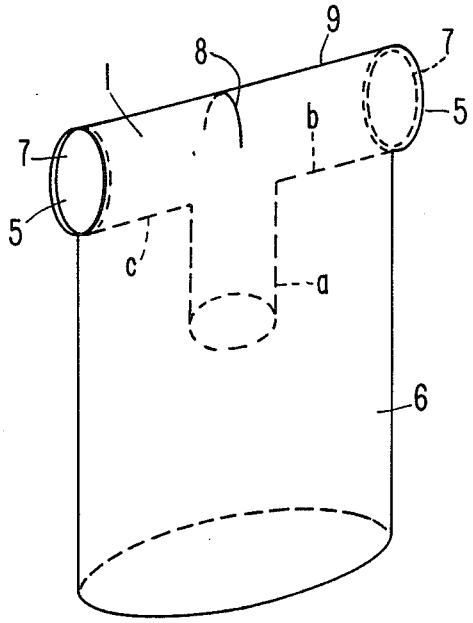
FIG. 2 is a schematic perspective view of the separating member of FIG. 1 fitted into a flexible container.

FIG. 1 shows a separating member 1 in the form of a T-shaped piece of material which may be fitted into a flexible container 6 having integral lifting loops 9 as shown in FIG. 2. The piece of material is preferably of flexible material. However, the piece of material can also be a rigid pipe having extensions of flexible material. The separating member serves as means for filling of bulk material, as means for separating that part of the container which is filled with bulk material, i.e. the cargo compartment, from the lifting area, and as means to enclose and maintain the bulk material in the container.

Figure 1A:
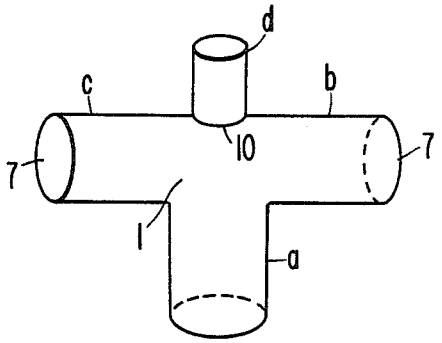
FIG. 1*a* is a similar view showing a modification thereof.

The T-shaped piece of material includes two horizontal branch pipes or side legs b and c defining openings 7 and a vertical branch pipe or leg a which in fact is a filling spout. In a horizontal pipe or section formed by legs b, c there can be an opening 10 with a vertical branch pipe or leg d as shown in FIG. 1*a* or without as shown in FIG. 1. In this case filling of bulk material can take place through the legs or branch pipes a and d. This embodiment can be used when a filling opening 8 is provided in the container lifting loops 9, as shown in FIG. 2. The branch pipes b and c need not necessarily form an angle of 90° with the branch pipe a as shown in FIG. 1, but rather the three branch pipes a, b, c can form a Y (not shown).

Figure 4:
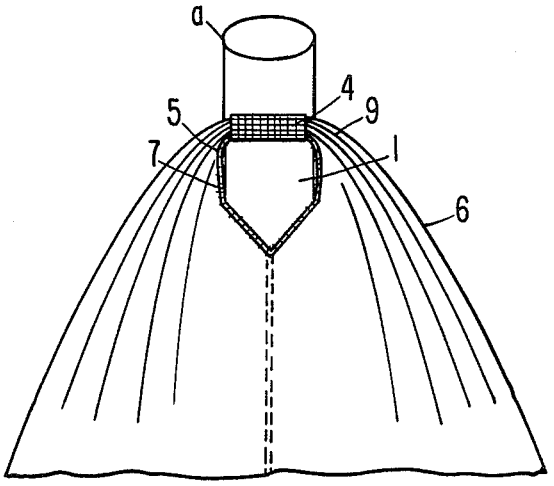
FIG. 4 is a side view of the upper part of a flexible container fitted with the separating member of FIG. 3.
Figure 8:
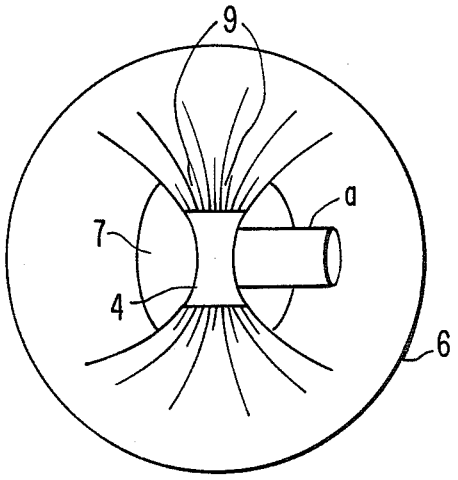
FIG. 8 is a plan view from above FIG. 4.

The branch pipes a, b, c and d can have variable lengths and at least one of the branches can have a length equal to 0, i.e. such that such at least one branch is not provided. The total length of the horizontal section including the branch pipes c and b can be equal to or less than the width of the flat-laid container. Parts of the branch pipes a, b, c, d or extensions of these can be used for forming at least one permanent lifting handle 4 (FIGS. 4 and 8). The branch pipe a can be placed in the center of the horizontal section or off-center relative thereto. The diameter of the branch pipe a can be less than or equal to the diameter of the container.

Figure 2A:
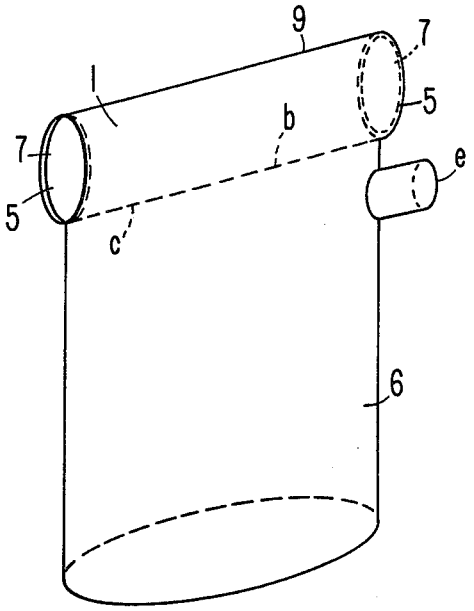
FIG. 2*a* is a view similar to FIG. 2 but showing a modified separating member and filling spout.
Figure 7:
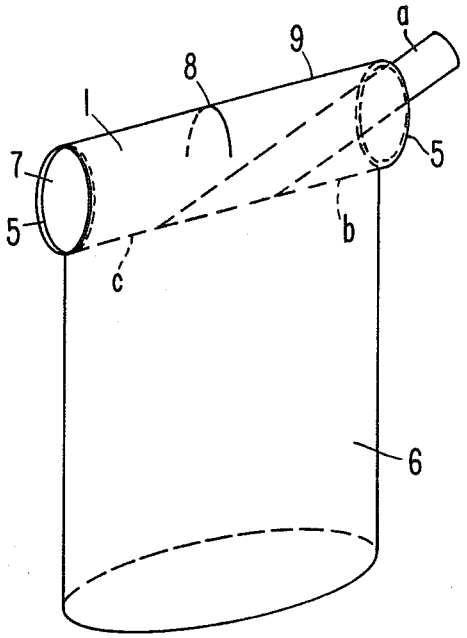
FIG. 7 is a view similar to FIG. 2, but showing a portion of the separating member drawn out through one lifting opening of the flexible container.

FIG. 2 shows the upper part of container 6 with lifting loops 9 and openings or "armpits" 5 thereof for insertion therethrough of conventional lifting means. In the container 6 is fitted the T-shaped separating member 1 which is fastened around openings 7 to the container around openings 5. The leg a forming the filling spout can be drawn out before filling through one of the branch pipes b, c, as shown in FIG. 7, or out through opening 10 in the horizontal section formed by branch pipes b, c and the opening 8. The filling can take place through the filling spout a. After filling is completed, the filling spout a is closed and the lifting loops (only one of which is visible in the side view of FIG. 4) are pressed together and gathered, for instance as shown in FIGS. and 8, to form a lifting handle 4. Alternatively, filling can be achieved through a separate filling spout 3 in the wall of container 6 (FIG. 2*a*) and extending into the cargo compartment therein. The lifting area thereby is separated from the cargo compartment, and in this case the separating member can be a relatively rigid pipe. If the container topples, the bulk material cannot flow out through the openings 5.

When the container 6 has two or several lifting loops 9 which are joined together to form more than one permanent lifting handle, the edges adjacent the opening 10 in the piece of material are fastened to respective edges which are formed by the cut 8 in the container 6.

Figure 3:
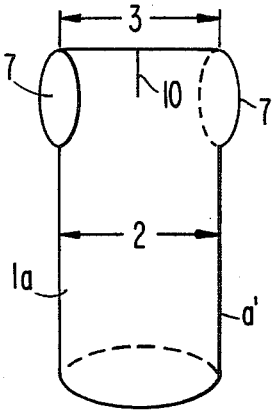
FIG. 3 is a schematic perspective view of a separating member in the form of a single pipe, i.e. without side legs.

FIG. 3 shows a tubular or pipe-shaped piece of material forming a separating member 1*a* without horizontal legs or branch pipes b and c, and having a diameter 2 which can be larger, equal to or less than the flat-laid width 3 between the openings 7. In a manner similar to that shown in FIG. 1 the pipe a' can have an opening 10 with or without an upward extension or leg d.

FIG. 4 shows the upper part of a container 6 having a lifting handle 4 and a separating member and fastened to the container along the edges of the openings 5. Before filling of bulk material the leg or branch pipe a is pulled out through one of the openings 5 (as shown in FIG. 7), and after filling the leg a can be lashed.

Figure 5:
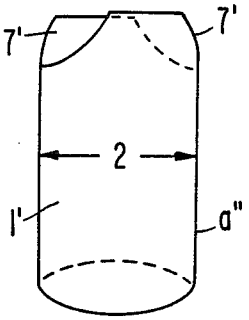
FIG. 5 is a schematic perspective view of a modification of the separating member of FIG. 3, where the upper part of the member is cut off, such that opposite ends thereof are completely open.

FIG. 5 shows a separating member 1' formed by a piece of material corresponding to that shown in FIG. 3, but with the upper part thereof removed or cut off so that the separating member is cylindrical and forms a filling spout a'' which is completely open at both ends. The openings 7 shown in FIG. 3 thereby are replaced by semicircular openings or side edges 7'. The edges adjacent openings 7' are fastened to the container adjacent lower parts of the openings 5 and the upper parts of the lifting loops can be joined together by a sleeve-shaped lifting handle. Thereby, the lifting area is separated from the cargo compartment. The filling spout a is closed after filling, for instance by lashing, and thus the lifting area will be entirely separated from the cargo compartment so that the bulk material cannot flow out therefrom.

Figure 6:
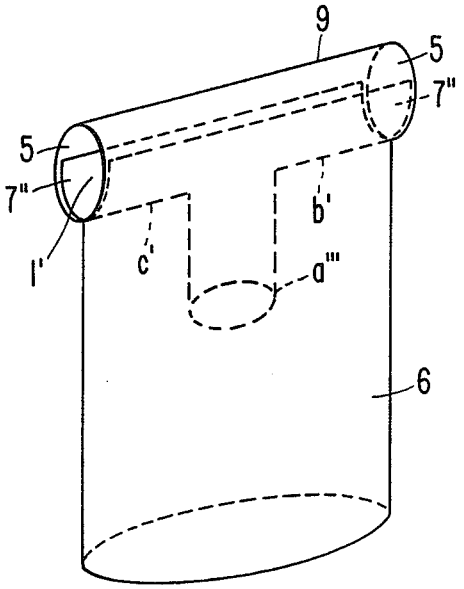
FIG. 6 is a schematic perspective view similar to FIG. 2, but wherein the top of a T-shaped separating member has been removed from the horizontal part that is joined to the upper part of the flexible container.

FIG. 6 shows a separating member 1'' having a T-shape similar to FIG. 1, but with the top of the horizontal section removed similar to FIG. 5, within a container 6. The branches b' and c' of the piece of material semicircular have openings 7'' and are fastened at edges adjacent thereto to the container adjacent lower parts of openings 5. The edges of member 1'' between the openings 7'' are fastened to the walls of the container between the openings 5 or are pressed tightly against the container walls by means of a lifting handle sleeve, thus separating the lifting area from the cargo compartment. Bulk material can be filled into the container 6 by a filling spout a'' which can be an integral part of the separating member 1'' (as shown in FIG. 6) or by a separate filling spout in the wall of the container similar to e of FIG. 2*a*. After filling, the filling spout is closed and bulk material accordingly cannot flow out of the container 6. Use of a separating member 1' or 1'' as shown in FIGS. 5 and 6 reduces the consumption of cloth material compared to application of separating member 1 and 1*a* of FIGS. 1–3, and when the lifting loops are joined with a lifting handle this can be done in an easier way since less cloth material has to be gathered together.

If a liner is provided in the container 6, the fill opening of the liner will of course be pulled out through the filling spout of the separating member 1, 1', 1*a* or 1''. Filling of bulk material will of course be carried out in such a way that no bulk material gets between the outside of the liner and the separating member 1, 1', 1*a* or 1''.

The present invention provides a simple way of preventing bulk material from flowing out of a container having integral lifting loops if the container topples. Also, contaminants cannot damage the liner, and contaminants cannot get in between the container's walls and the liner and during discharge flow out together with the bulk material and contaminate it. Further, the separating member 1, 1', 1*a* or 1'' will protect the liner against damage by a lifting means. In spite of the fact that the separating member is between the lifting area and the cargo compartment, filling of bulk material still is achieved simply.

We claim:

1. In a flexible container for transportation and storage of bulk material and including an interior having a lower cargo compartment to be filled with bulk material and defined by side walls, and an upper lifting area defined by integral lifting loops which are formed by direct extensions of the material of said side walls, and lifting openings through said material to said interior of said container for the receipt of lifting means, whereby bulk material may be filled into said cargo compartment via said lifting area through one of said lifting openings, the improvement of means for separating said cargo compartment from said lifting area and for closing said cargo compartment to prevent spillage therefrom of bulk material filled therein, said separating means comprising:

a separating member positioned within said lifting area of said container, said separating member being fastened to said container at positions adjacent edges of said lifting openings thereof; and said separating member including at least one integral portion formed of a flexible material and defining a filling spout for being drawn out through one of said lifting openings during a filling operation, such that bulk material may be filled therethrough into said cargo compartment, and for being closed after completion of such filling operation and thereby closing the thus filled said cargo compartment.

2. The improvement claimed in claim 1, wherein said separating member comprises a tubular member with an open bottom and a closed top with opposite lateral openings aligned with respective said lifting openings, said separating member being fastened at edges along said lateral openings to said container adjacent edges of respective said lifting openings.

3. The improvement claimed in claim 1, wherein said separating member includes two oppositely directed lateral branches defining lateral openings, said separating member being fastened at edges along said lateral openings to said container adjacent edges of respective said lifting openings, and said integral portion of said separating member comprises a vertical branch extending downwardly from said two lateral branches.

4. The improvement claimed in claim 3, wherein said separating member is substantially T-shaped.

5. The improvement claimed in claim 3, wherein the distance between said lateral openings is greater than the lateral dimension of said vertical branch.

6. The improvement claimed in claim 1, wherein the material of at least a portion of said separating member forms means for, upon filling of said cargo compartment, being wrapped about at least one of said lifting loops to thereby form a permanent lifting handle.

7. The improvement claimed in claim 1, wherein top portions of said container and said separating member have formed therein aligned filling openings through which can be drawn out said filling spout during a filling operation.

8. The improvement claimed in claim 7, wherein said separating member is fastened to said container adjacent edges of said filling opening therein, wherein said lifting loops and fastened portions of said separating member can be gathered together to form two permanent lifting handles on opposite sides of said filling openings.

9. The improvement claimed in claim 1, wherein said separating member comprises a tubular member with an open bottom and an open top, said open top being defined by laterally opposite curved edges fastened to said container adjacent lower edges of respective said lifting openings.

10. The improvement claimed in claim 9, wherein said curved edges are substantially semicircular.

11. The improvement claimed in claim 1, wherein said separating member includes two oppositely directed lateral branches open at the top thereof and having laterally opposite curved edges fastened to said container adjacent lower edges of respective said lifting openings, and said integral portion of said separating member comprises a vertical member extending downwardly from said two lateral branches.

12. The improvement claimed in claim 11, wherein said curved edges are substantially semicircular.

13. The improvement claimed in claim 11, wherein said separating member is substantially T-shaped.

14. The improvement claimed in claim 11, wherein the distance between said curved edges is greater than the lateral dimension of said vertical branch.

15. The improvement claimed in claim 1, wherein said separating member includes an upwardly extending branch passing through the top of said container.

16. The improvement claimed in claim 1, further comprising a filling spout extending through said container into said cargo compartment.

* * * * *